US007581995B1

(12) United States Patent
Govan

(10) Patent No.: US 7,581,995 B1
(45) Date of Patent: Sep. 1, 2009

(54) NET AND LINE CUTTER

(76) Inventor: Donald T. Govan, P.O. Box 350246, Fort Lauderdale, FL (US) 33335

( * ) Notice: Subject to any disclaimer, the term of this patent is extended or adjusted under 35 U.S.C. 154(b) by 0 days.

(21) Appl. No.: 12/386,511

(22) Filed: Apr. 20, 2009

(51) Int. Cl.
*B63H 1/28* (2006.01)

(52) U.S. Cl. ..... 440/73; 416/146 R

(58) Field of Classification Search ..... 440/73; 416/146 R
See application file for complete search history.

(56) References Cited

U.S. PATENT DOCUMENTS 4,447,215 A 5/1984 Govan
4,450,670 A * 5/1984 Robinson ..... 56/8
4,507,091 A 3/1985 Govan
4,544,363 A 10/1985 Govan
4,801,281 A 1/1989 Govan
4,943,249 A 7/1990 Govan
5,017,167 A 5/1991 Govan
5,052,957 A 10/1991 Govan
5,547,408 A 8/1996 Skyman
5,807,150 A * 9/1998 Minter, Sr. ..... 440/73
6,004,174 A 12/1999 Govan

* cited by examiner

*Primary Examiner*—Stephen Avila
(74) *Attorney, Agent, or Firm*—Alvin S. Blum

(57) ABSTRACT

Apparatus shears foreign matter that might entangle propellers and related structures on a moving vessel by action of a blade rotating with the propeller that cooperates with a non-rotating blade held close to the rotating blade. The mechanisms for holding the blades close and parallel include a lubricant packed passage for a supporting cylinder portion of the non-rotating blade, enclosed clamping elastic bias elements for controlled movement of the cylinder, and adjustments for holding the blade parallel.

3 Claims, 10 Drawing Sheets

NET AND LINE CUTTER

FIELD OF THE INVENTION

This invention relates generally to marine devices that cut lines, weeds, nets, and the like, and more particularly to shearing cutters that employ a blade rotating with the propeller of a vessel that cooperates with a non-rotating blade mounted on a non-rotating portion of a vessel adjacent the propeller shaft to engage and shear items that appear between the two cutters. Lines, nets, weeds and the like are commonly encountered by vessels. They may be swept by the propeller blades into the propeller shaft apparatus i.e. into the space where the propeller shaft extends from its housing where they can cause great harm. There they may cut through the oil seals causing loss of lubricant. The current trend toward long line fishing wherein heavy monofilament nylon many miles long is lying in the water has exacerbated the problem.

DESCRIPTION OF RELATED ART

U.S. Pat. No. 6,004,174 issued Dec. 21, 1999 to applicant discloses a rotating blade that rotates with the propeller of a vessel that cooperates with a non-rotating blade on a non-rotating portion of a vessel adjacent the propeller shaft to shear foreign items that appear between the blades. The position of the propeller will change relative to the hull, advancing axially when under way in forward due to the forward thrust of the propeller. Heating and cooling of the shaft will also change propeller axial position. Means are provided for maintaining a close distance between the pair of radially extending shearing cutters. A mechanism senses propeller location and a moving mechanism moves the non-rotating blade to accommodate these changes in relative propeller location to maintain a fixed, very close spacing between the two blades for effective shearing action. The non-rotating blade moves axially within its support. A slot follower connected to the non-rotating blade engages a slot carried by the rotating blade to adjust the axial position of the non-rotating blade to compensate for axial movement of the rotating blade. A wedge and valley mechanism holds the two blades together when a foreign item is engaged to enhance shearing action. An adjustable clamping force restrains free axial movement of the non-rotating blade. This clamping force is applied by screw adjustments that include polyurethane elastomeric segments. Over time, these elastomeric segments deform so that the preset clamping force is reduced to unacceptable levels. It has been found that over time, the support for axial movement of the non-rotating blade becomes bound by its exposure to sea water. When the vessel is in dry dock, the rope guard onto which the support for the non-rotating blade is welded must be cut away for maintenance access to the propeller shaft bearings and/or seals. When the rope guard is welded back in place, it is difficult to reposition the non-rotating blade support so that the non-rotating blade is parallel to the rotating blade. If the non-rotating blade and support are broken away during operation, it would be useful to be able to replace them underwater. This is not feasible with the prior art apparatus because parallel relationship of the blades cannot be adjusted.

BRIEF SUMMARY OF THE INVENTION

It is accordingly an object of the invention to provide improvements to the prior art rotary weed and line cutter to overcome the problems encountered in long term use of the device. It is an object of the invention to overcome the deformation of the elastomeric segment. It is an object of the invention to overcome the binding action on the axial motion support by lubricant enclosure. It is a further object of the invention to provide means for enabling enhanced adjustment of positioning of the non-rotating blade support assembly even under water so that the non-rotating blade will be parallel to the rotating blade.

The system includes a non-rotating blade that has a shearing plane perpendicular to the axis of rotation of the shaft. This blade rides in a blade holder that permits limited axial movement of the blade. The blade holder generally mounts on a strut or the rope guard that surrounds the rotary shaft and its bearing. One or more rotating blades are mounted on the propeller hub or shaft with a shearing plane parallel to the non-rotating blade. The shearing planes of the two blades must be very close together for effective cutting. To ensure optimal axial positioning of the two blades, the rotating blade carries along with it a positioning groove or slot. The non-rotating blade carries a slot follower with tapered leading and following edges. As the slot encounters a tapered edge of the slot follower during its rotation, the slot follower and its blade are moved axially until the slot follower fits into the slot, thereby moving the two blades into the blade spacing necessary to begin the shearing action. Adjustable damping means are provided to slow the axial movement to avoid excessive axial movement between revolutions from the thrust of the moving water that includes means for maintaining a preset tension of the damping adjustment over time. A wedge and valley mechanism is also provided to bring the blades together for shearing when an item appears between them. These and other objects, features and advantages of the invention will become more apparent when the detailed description is studied in conjunction with the drawings, in which like reference characters indicate like elements in the various drawing figures.

DETAILED DESCRIPTION OF PREFERRED EMBODIMENTS

Figure 1:
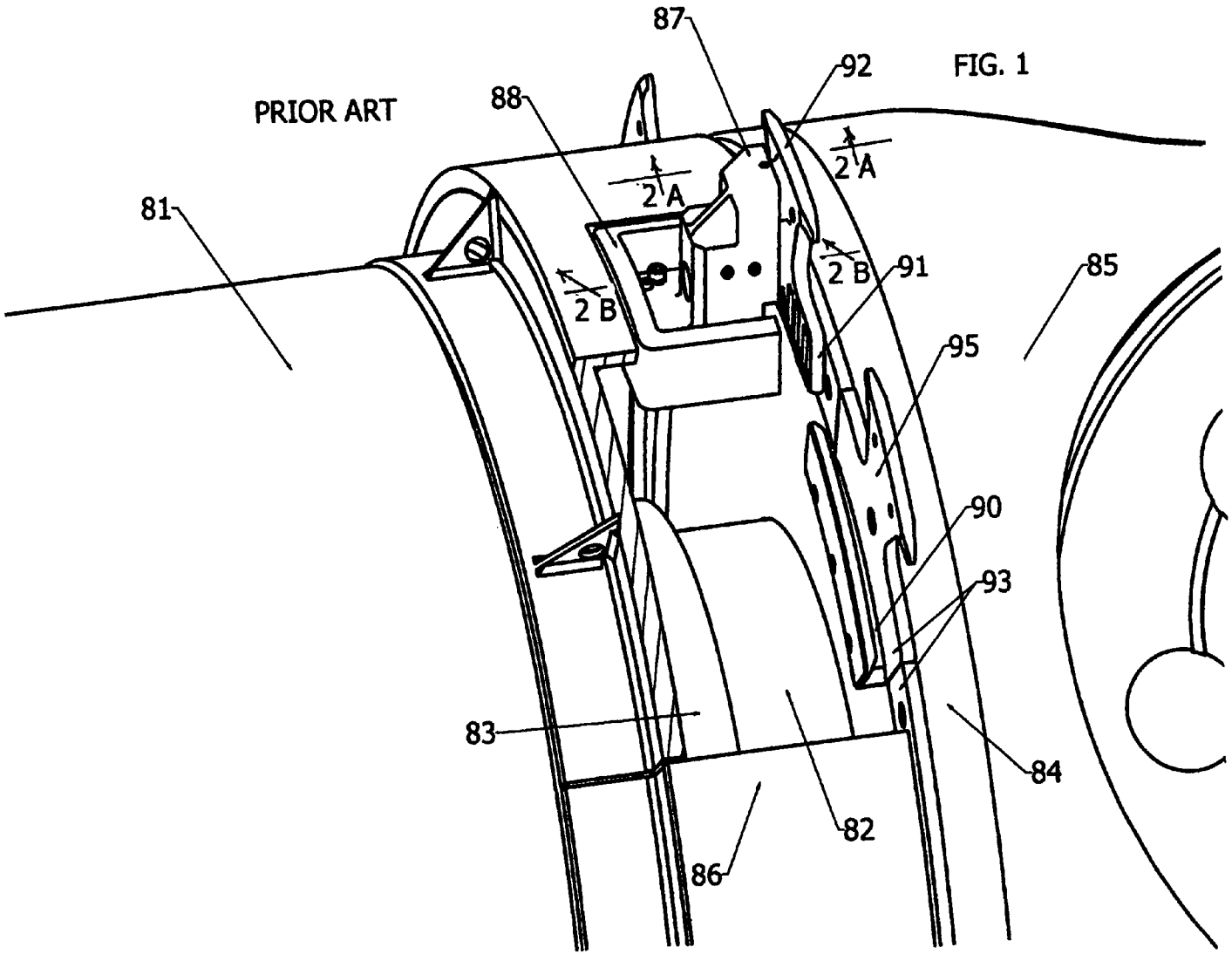
FIG. 1 PRIOR ART
FIG. 1 is a perspective view, partially cut away, of a cutter apparatus of the prior art.
Figure 2A:
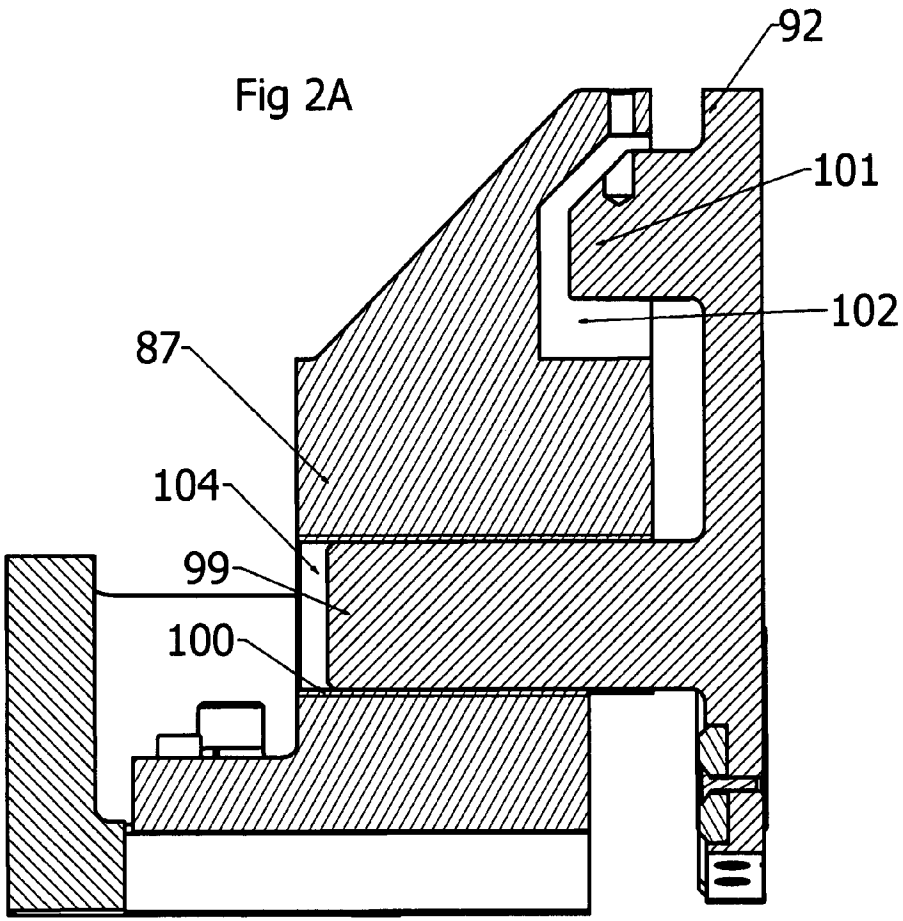
Fig 2A Prior Art
FIG. 2A is a sectional detail view through line 2A-2A of FIG. 1.
Figure 2B:
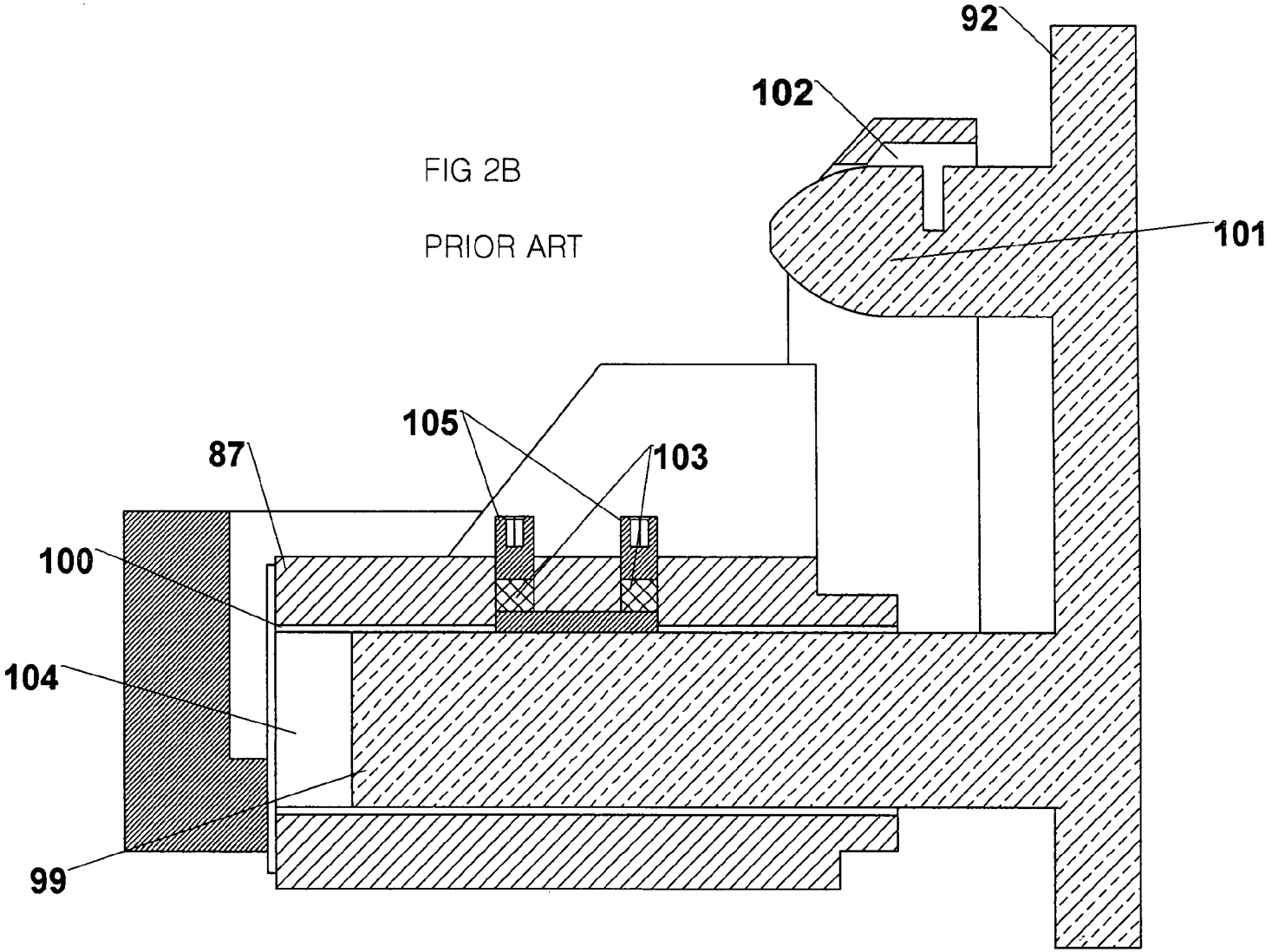
FIG 2B PRIOR ART
FIG. 2B is a sectional detail view through line 2B-2B of FIG. 1.
Figure 3:
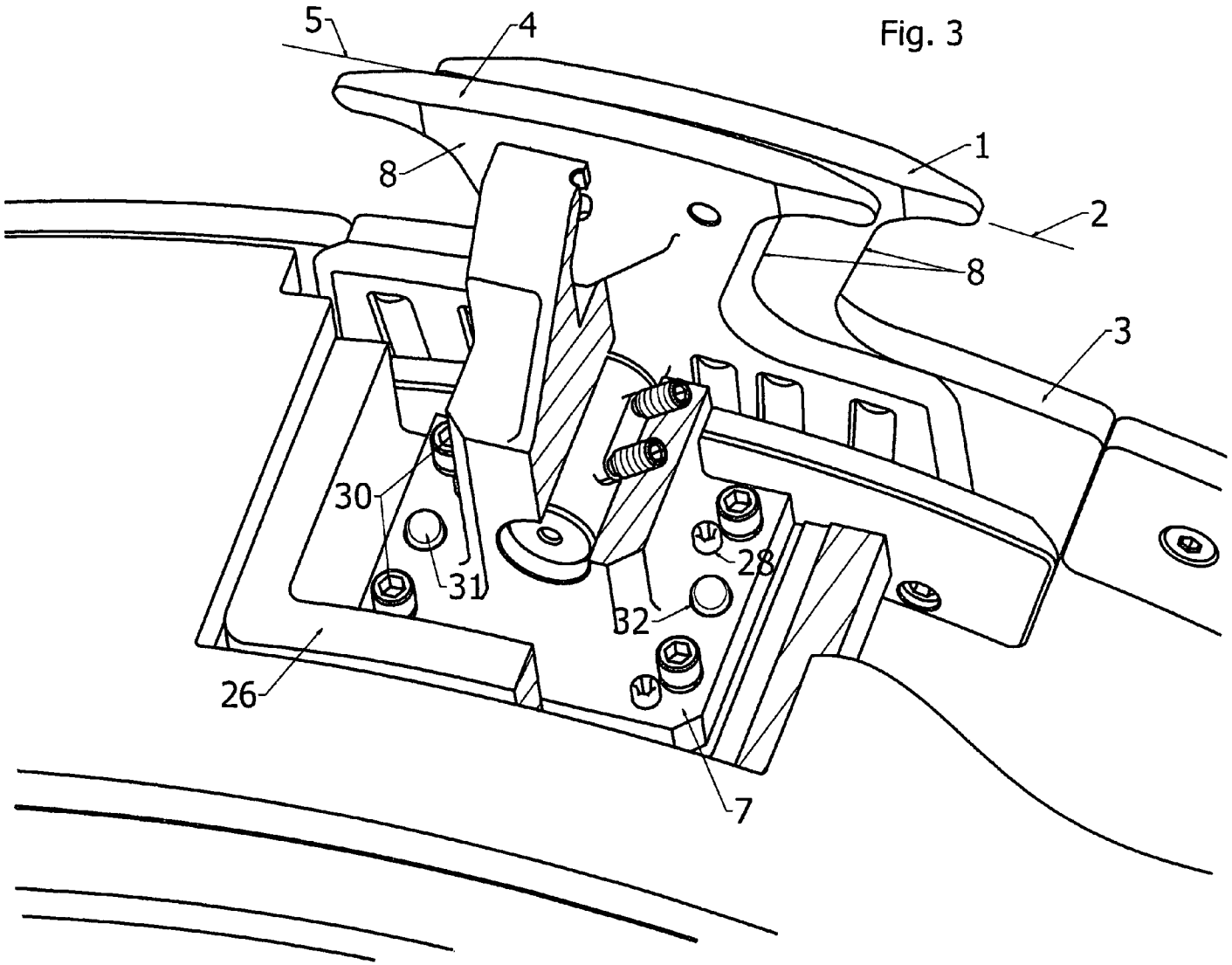
FIG. 3 is a sectional isometric view of the cutter of the invention.
Figure 4:
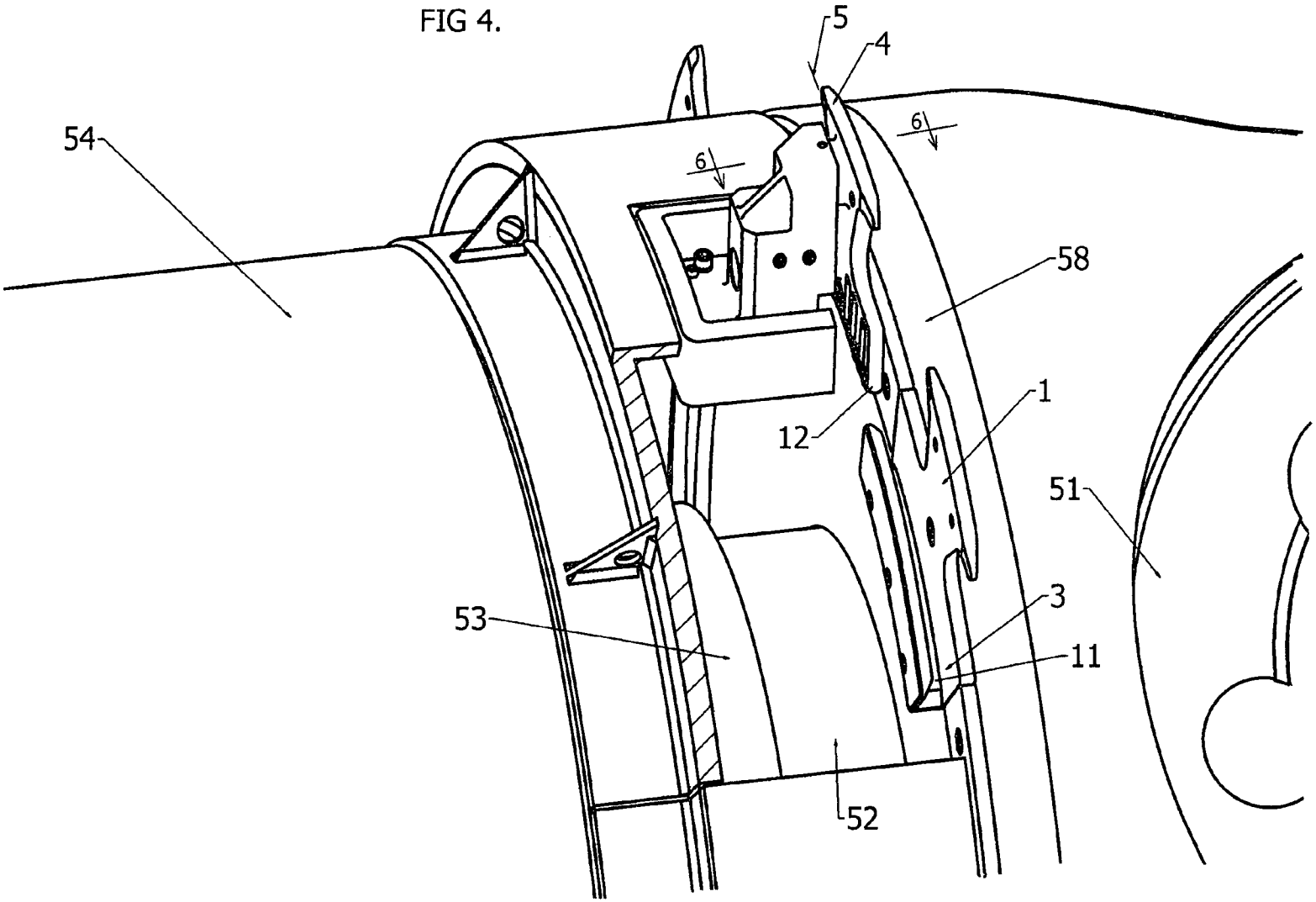
FIG. 4 is a perspective view, partially broken away, of the apparatus of the invention installed on a vessel.
Figure 5:
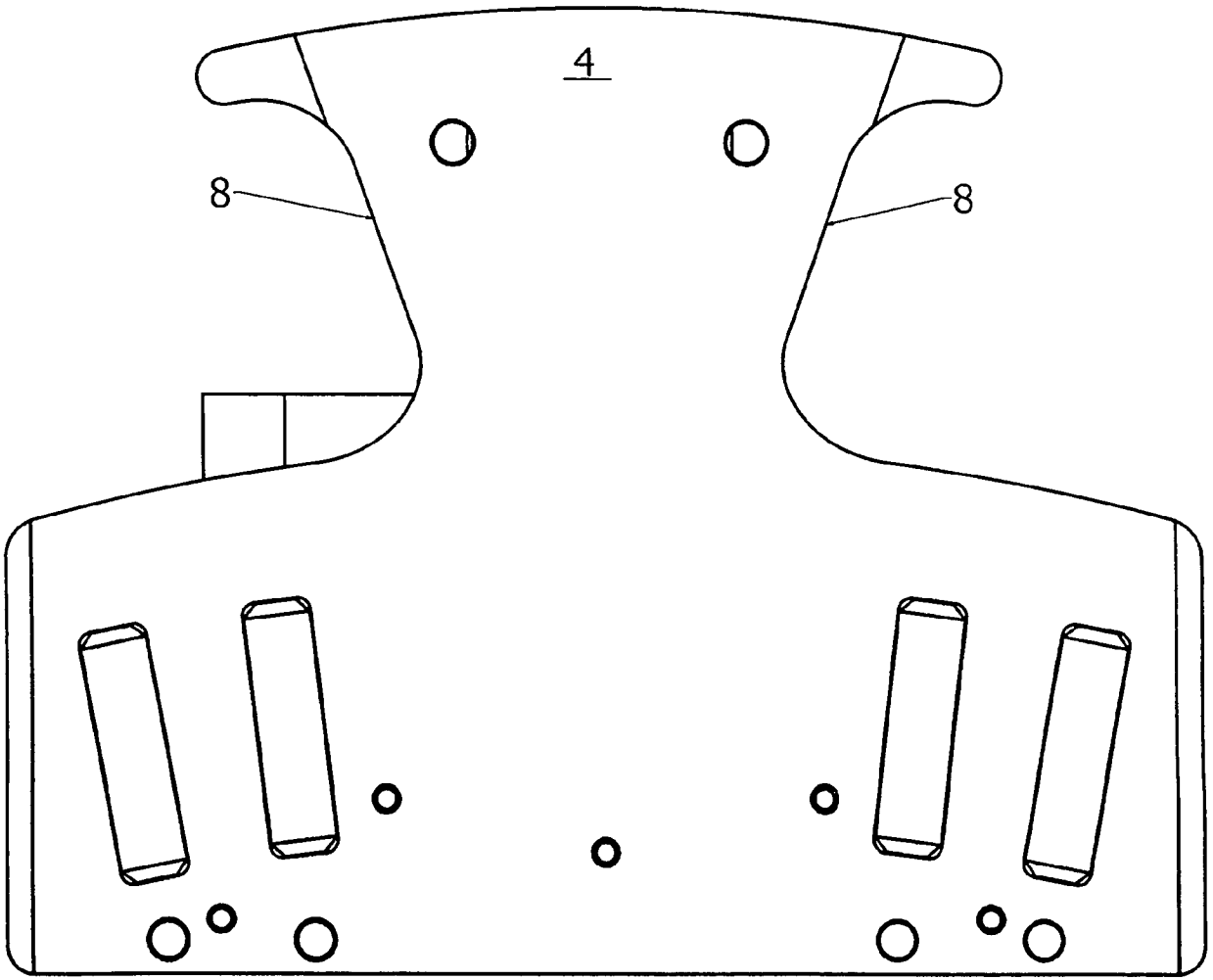
FIG. 5 is a front elevation view of the non rotating portion of the cutter of the invention.
Figure 6:
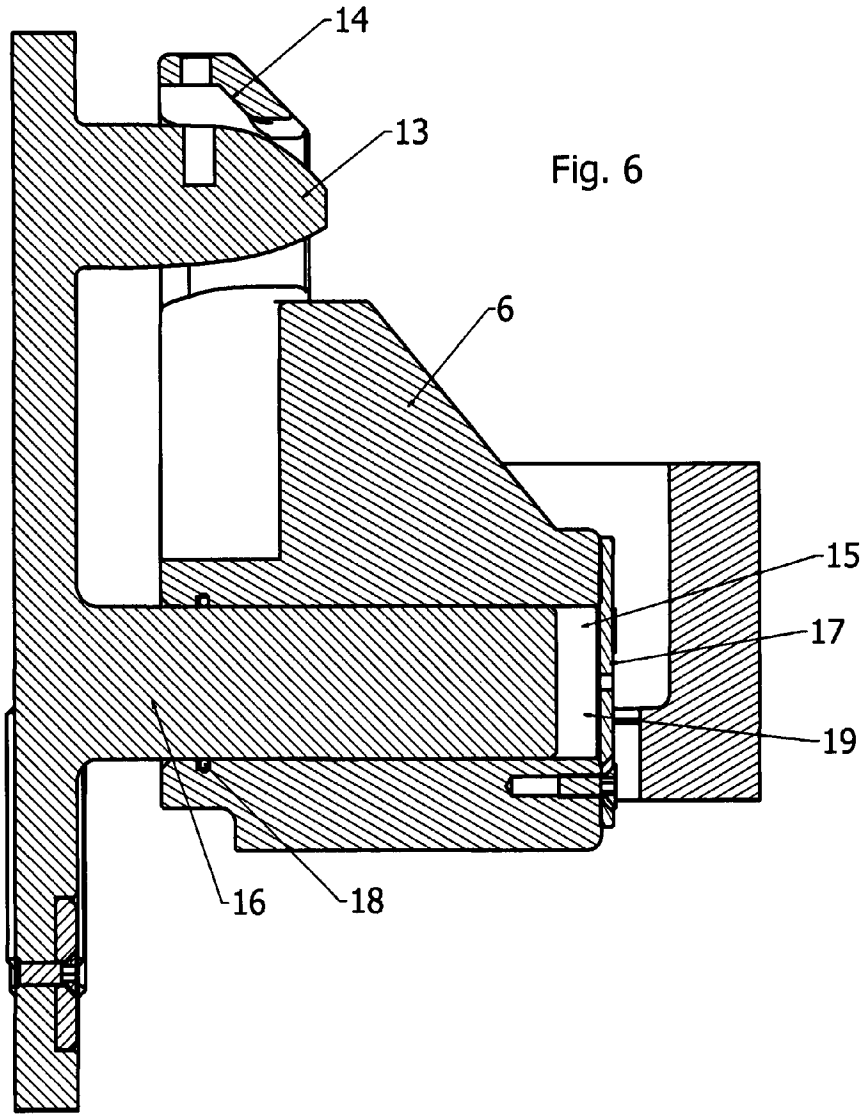
FIG. 6 is a sectional view through line 6-6 of FIG. 4.
Figure 8:
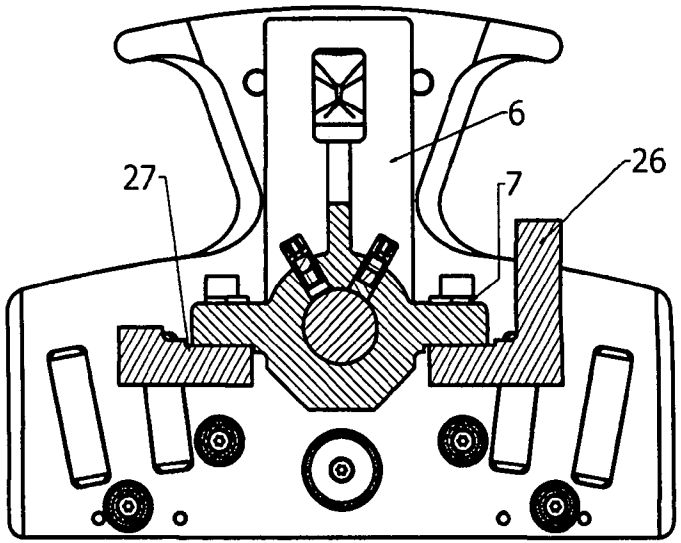
FIG. 8 is a sectional view through line 8-8 of FIG. 7.
Figure 7:
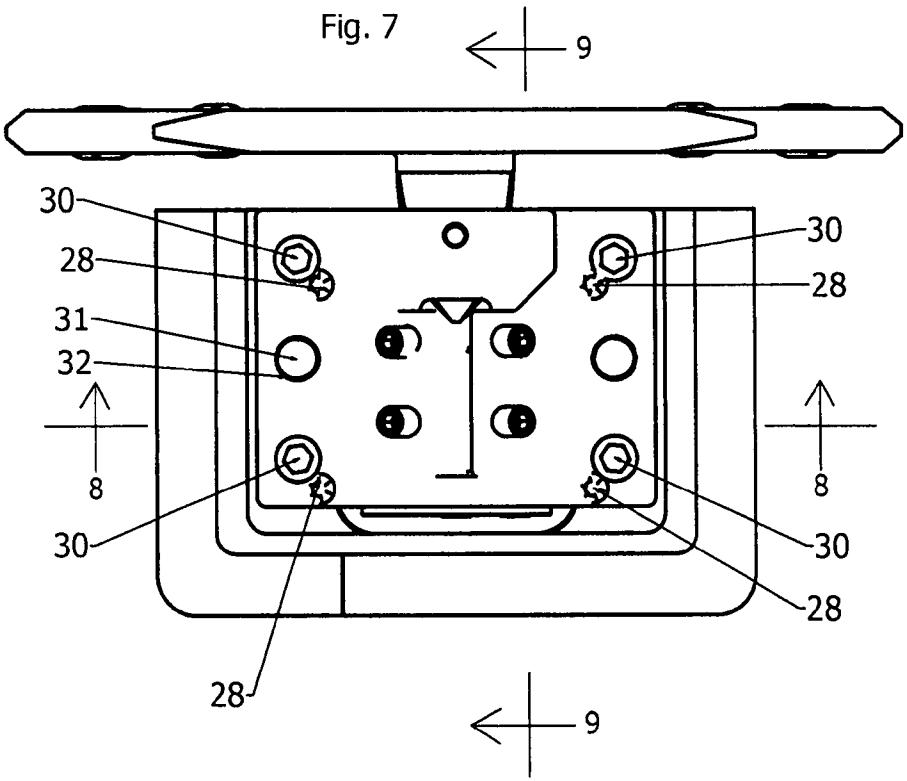
FIG. 7 is a top view of the non rotating portion of the cutter of the invention.
Figure 9:
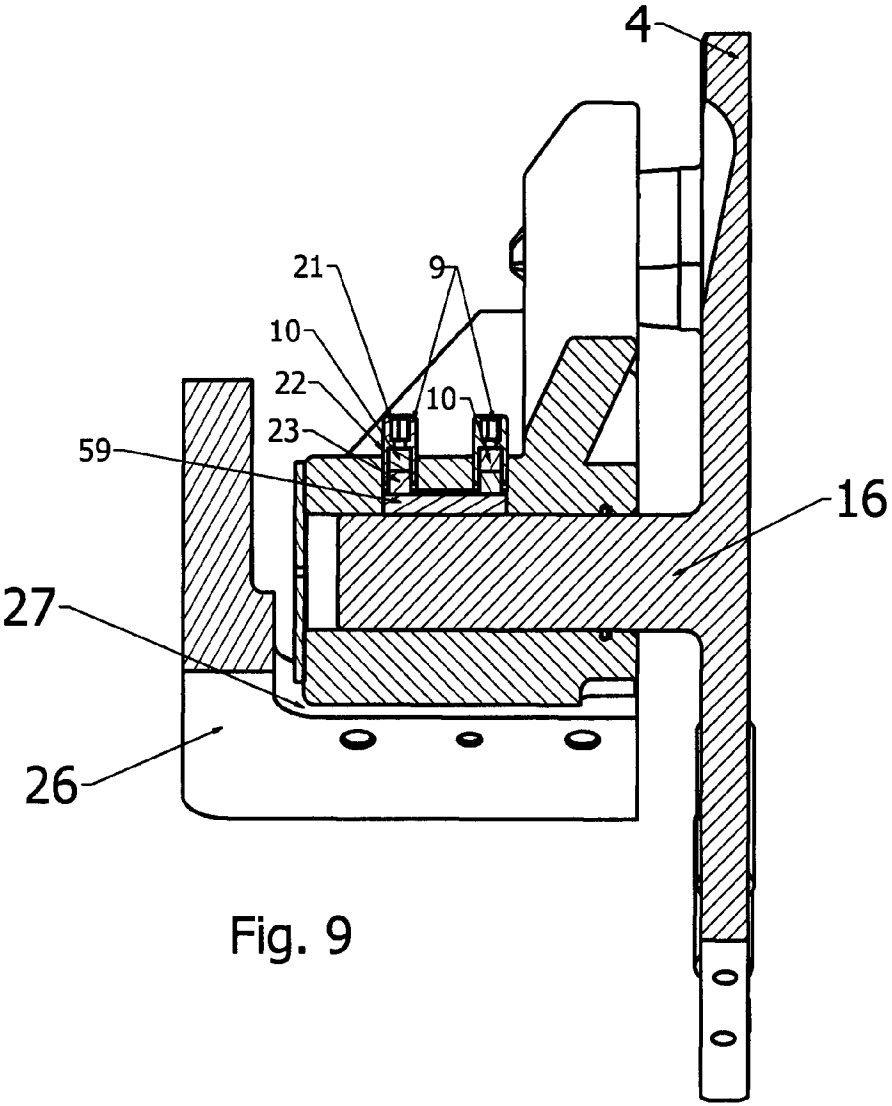
FIG. 9 is a sectional view through line 9-9 of FIG. 7.
Figure 10:
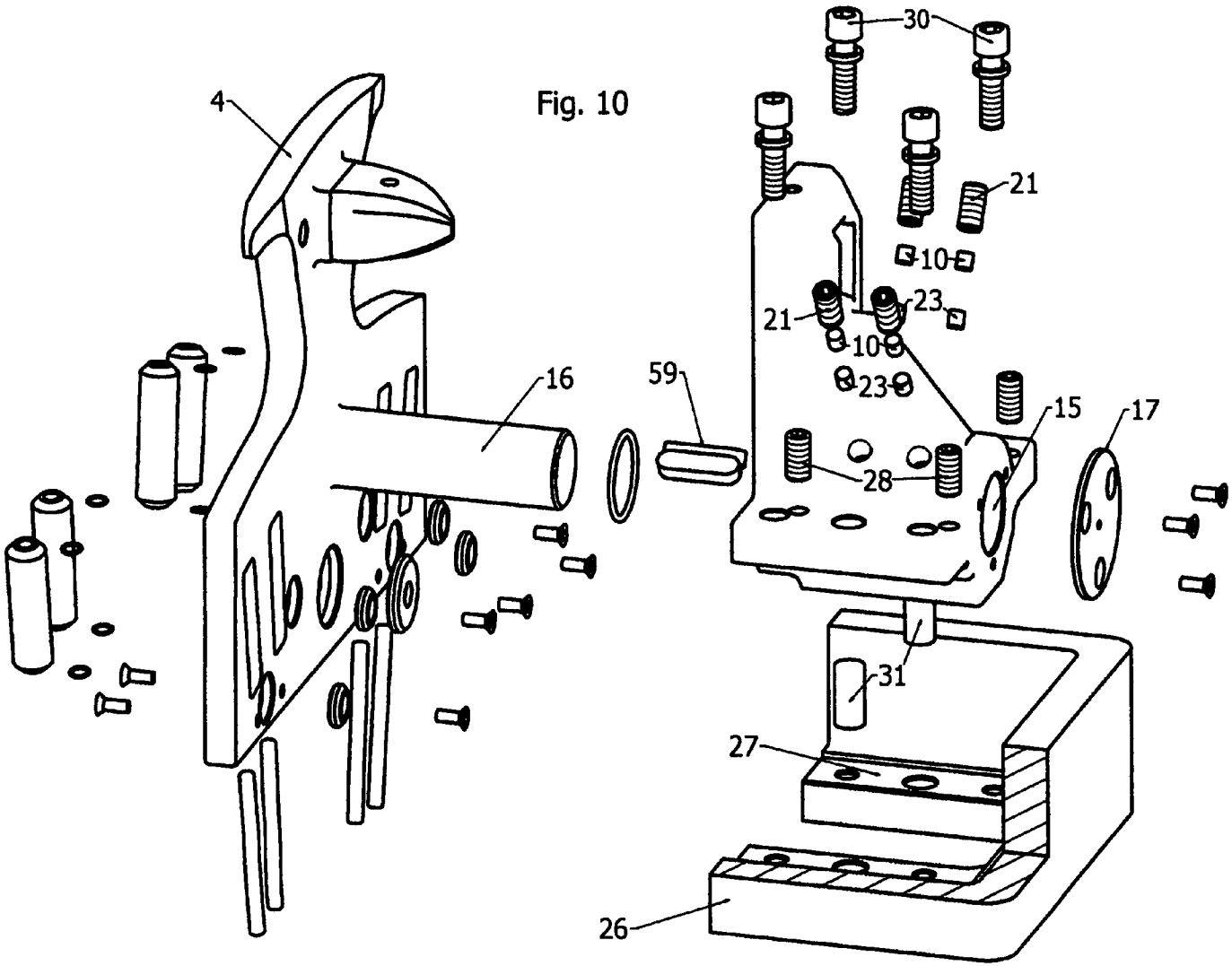
FIG. 10 is an exploded view of the no-rotating portion of the cutter of the invention.

Referring now first to description of the prior art in FIGS. 1, 2A and 2B, a vessel 81 has a propeller shaft 82 journalled within a propeller shaft housing 83 with a propeller hub 84 carrying propeller 85 affixed to the shaft. A rotating blade assembly 93 is affixed to the shaft or propeller hub. A rope guard 86 surrounds the shaft and is fixed to the vessel. A support block 87 for supporting the non-rotating blade 92 is bolted to the rope guard 86 in correct position for cooperating with the rotating blade assembly 93. The support block 87 is bolted by bolts to support member 88 that is welded to the rope guard. The support member is held to correct non-rotating blade position relative to the rotating blade assembly 93 and then welded to the rope guard 86. During dry dock maintenance operations, the rope guard may be cut off in order to access the shaft bearing and/or seal. To weld it back in correct position is a difficult task. The rotary blade assembly 93 is bolted to the propeller hub 84 so that the rotary blade 95 extends radially beyond the hub 84, with its shear plane perpendicular to the axis of shaft 82. This positions the blade 95 so that it catches foreign matter as it turns and twists it inward where it will be caught and sheared against the non-rotating blade 92. Blade 92 is held radially extended with its shearing plane parallel to the shearing plane of the rotary blade by the support block 87. During operation of the vessel, various forces are at work that tend to move the propeller axially relative to the supporting structures holding the non-rotating blade 92. These forces include thrust of the propeller blades against the water and expansion and contraction from heating and cooling. In order to maintain optimum spacing of the two blades when the rotating blade is moved axially by these forces, the non-rotating blade supported by the fixed support block must move axially by a corresponding amount. A slot 90 on the rotating blade assembly 93 cooperates with slot follower 91 on blade 92 to maintain the relative positions of the two blades. The axial movement of blade 92 within support block 87 is provided by cylinder 99 extending from blade 92 which slides axially within lubricous sleeve bearing 100 fixed in axial hole 104 in support block 87. Adjustment screws 105 force elastomeric segments 103 against plates 106 to clamp the cylinder 99 in the sleeve. A wedge 101 affixed to blade 92 fits into valley 102 in support block 87. When foreign material is caught between the blades, the wedge is forced against the valley. This causes the blade 92 to move against the rotating blade 93 compressing the segments 103 as the cylinder twists in the sleeve. After prolonged operation, it has been found that the cylinder 99 no longer slides freely within the sleeve bearing 11, interfering with operation. Also, the elastomeric clamping segments 103 become deformed, losing their adjustment.

Referring now to the drawing FIGS. 3-10, the instant invention is shown with improvements to overcome the problems encountered with the prior art apparatus. A vessel hull 54 has a propeller shaft 52 journalled within a propeller shaft housing 53 with a propeller hub 58 carrying propeller 51 affixed to the propeller shaft 52. At least one first support rotating blade assembly 3 carrying a first blade 1 having a first shearing plane 2 is affixed to the shaft or propeller hub and arranged to rotate in conjunction with the propeller. The first support positions the first blade extending radially beyond the first support to engage foreign matter that may be encountered. At least one second blade 4 having a second shearing plane 5 is arranged with the second shearing plane substantially parallel to the first shearing plane. A second support 6 is adapted to support the second blade in a position extending radially parallel to the first blade to engage foreign matter for shearing foreign matter between the first and second blades, the second support 6 includes attaching means 7 for fixedly attaching support 6 to a non-rotating member of the hull; the first blade and the second blade each have radially extending shearing edges 8 on at least one margin of the shearing planes for cutting foreign matter when the propeller rotates. The second support is arranged to provide limited axial movement of the second blade with adjustable clamping means 9 for engaging the second blade with adjustable tension, the clamping means including elastic bias members 10 for maintaining adjustable tension. A combination of a slot 11 and a slot follower 12 regulate the axial position of the second blade. One of the combination of the slot and slot follower is connected to the first blade and the other is connected to the second blade. Each blade is arranged in a plane perpendicular to the axis 55 of the propeller shaft and extends through an arc so that the slot follower fits within the slot during a fraction of each rotation of the shaft to regulate the axial position of the second blade for close approximation of the first and second shearing planes for enhanced shearing action between the blades. The second support provides limited pivotal movement of the second blade. A combination of a wedge 13 and a valley 14 interact to apply axial force to move the second blade toward the first blade when the second blade pivots in the second support. One of the combination of the wedge and the valley is connected to the second blade and the other is connected to the second support, and the limited pivotal movement is generated by foreign matter the may be interposed between the first and second blades during propeller rotation.

The second support has an elongate, axially disposed cylindrical passage 15 that holds a cylindrical member 16 that is affixed to the second blade. It is adapted for limited movement of the blade as the cylindrical member reciprocates within the passage. The passage is provided with a lubricant seal such as, but not limited to, the plate 17 at a forward end thereof and a lubricant seal, such as but not limited to, the O-ring 18 at an aft end thereof for retention of lubricant 19 within the passage. The clamping mechanism 9 includes elastic bias members 10 that apply tension between the cylindrical member and the passage to limit motion therebetween. The elastic bias members 10 are enclosed within rigid elements including a piston 23 sliding within a rigid enclosing sleeve 22 that encloses the elastic bias member 10 to prevent deformation of the elastic bias members over time. Sleeve 22 is part of adjustment bolt 21 that is threadedly engaged in support 6 for providing adjustable clamping force on plate 59 that is forced against the cylindrical member 16.

Attaching means 7 fixedly attach the second support 6 to a non-rotating member of the hull 54. Attaching means 7 comprise a rigid metal member 26 for affixing to the hull by such well known affixing means as welding, the rigid metal member 26 having a first surface 27 adapted for receiving thereon at least one alignment screw member 28 threadedly engaged by the second support 6. The first surface is provided with at least two threaded apertures 29 for receiving threaded fasteners 30 from the second support for removably affixing the metal member to the second support after the at least one alignment screw member has been adjusted to maintain the second shearing plane parallel to the first shearing plane. A fixed rod 31 extends upwardly from the first surface 27. The rod 31 is received loosely in aperture 32 in support 6 while manipulating the alignment screw(s) 28 before securing the alignment with fasteners 30.

The above disclosed invention has a number of particular features which should preferably be employed in combination, although each is useful separately without departure from the scope of the invention. While I have shown and described the preferred embodiments of my invention, it will be understood that the invention may be embodied otherwise than herein specifically illustrated or described, and that certain changes in form and arrangement of parts and the specific manner of practicing the invention may be made within the underlying idea or principles of the invention.

The invention claimed is:

1. In an apparatus that cuts foreign matter including lines, wires, nets and weeds that may be encountered by propeller driven vessels when under way, said vessels where the propeller is mounted to a rotatable propeller shaft that extends from a propeller shaft housing connected to the vessel's hull, and in which there is axial movement of said propeller shaft, said apparatus having:

at least one first blade having a first shearing plane, said first blade arranged to rotate in conjunction with said propeller with said first shearing plane substantially perpendicular to the shaft axis; a first support adapted to support said first blade in a position extending radially beyond said first support to engage said foreign matter, said first support adapted to fixedly attach to at least one member of the pair consisting of said shaft and said propeller; at least one second blade having a second shearing plane, said second blade arranged with said second shearing plane substantially parallel to said first shearing plane; a second support adapted to support said second blade in a position extending radially parallel to said first blade to engage said foreign matter for shearing said foreign matter between said first and second blades, said second support including attaching means for fixedly attaching to a non-rotating member of said hull; said first blade and said second blade each having radially extending shearing edges on at least one margin of said shearing planes for cutting said foreign matter when said propeller rotates; said second support arranged to provide limited axial movement of second blade with adjustable clamping means for limiting movement of said second blade with adjustable tension, said clamping means including elastic bias members for maintaining said adjustable tension; a combination of a slot and a slot follower for regulating the axial position of said second blade, one of said combination of said slot and said slot follower connected to said first blade and the other connected to said second blade, each arranged in a plane perpendicular to said axis of said propeller shaft and extending through an arc so that said slot follower fits within said slot during a fraction of each rotation of said shaft to regulate the axial position of said second blade for close approximation of said first and second shearing planes for enhanced shearing action between said blades, said second support providing limited pivotal movement of said second blade; a combination of a wedge and a valley for interacting to apply axial force to move said second blade toward said first blade when said second blade pivots in said second support; one of said combination of said wedge and said valley is connected to said second blade and the other is connected to said second support, and said limited pivotal movement is generated by said foreign matter interposed between said first and second blades during propeller rotation, wherein the improvement in the apparatus comprises:

a) said second support having an elongate, axially disposed cylindrical passage that holds a cylindrical member affixed to the second blade adapted for limited movement of the blade as the cylindrical member reciprocates within the passage, the passage provided with a lubricant seal at a forward end thereof and a lubricant seal at an aft end thereof for retention of lubricant within said passage;

b) said adjustable clamping means for limiting movement of said second blade including said elastic bias members applying tension between the cylindrical member and the passage to limit motion therebetween, the elastic bias members being enclosed within rigid elements including a piston sliding within an enclosing sleeve to prevent deformation of the elastic bias members over time;

c) said attaching means for fixedly attaching said second support means to a non-rotating member of said hull comprising a rigid metal member for affixing to the hull, the rigid metal member having a first surface adapted for receiving thereon at least one alignment screw member threadedly engaged by said second support, the first surface provided with at least two threaded apertures for receiving threaded fasteners from said second support for removably affixing the metal member to said second support after said at least one alignment screw member has been adjusted to maintain said second shearing plane parallel to said first shearing plane.

2. The apparatus according to claim 1, further comprising a fixed rod extending upwardly from said first surface and an aperture in said second support arranged to loosely receive said rod therein while manipulating said alignment screw members.

3. In an apparatus that cuts foreign matter including lines, wires, nets and weeds that may be encountered by propeller driven vessels when under way, said vessels where the propeller is mounted to a rotatable propeller shaft that extends from a propeller shaft housing connected to the vessel's hull, and in which there is axial movement of said propeller shaft, said apparatus having:

at least one first blade having a first shearing plane, said first blade means arranged to rotate in conjunction with said propeller with said first shearing plane substantially perpendicular to the axis of said shaft; a first support adapted to support said first blade in a position extending radially beyond said first support to engage said foreign matter, said first support adapted to fixedly attach to at least one member of the pair consisting of said shaft and said propeller;

at least one second blade having a second shearing plane, said second blade arranged with said second shearing plane substantially parallel to said first shearing plane of said first blade; a second support adapted to support said second blade in a position extending radially parallel to said first blade to engage said foreign matter for shearing said foreign matter between said first and second blades, said second support including attaching means for fixedly attaching to a non-rotating member of said hull; said first blade and said second blade each having radially extending shearing edges on at least one margin of said shearing planes for cutting said foreign matter therebetween, when said propeller rotates; said second support adapted to provide limited axial movement of second blade with adjustable clamping means for engaging said second blade means with adjustable tension, said clamping means including elastic bias members for maintaining a preset tension;

a combination of a slot and a slot follower for regulating the axial position of said second blade, one of said combination of said slot and said slot follower connected to said second blade and the other connected to said first blade, each arranged in a plane perpendicular to said axis of said propeller shaft and extending through an arc so that said slot follower means fits within said slot means during a fraction of each rotation of said shaft to regulate the axial position of said second blade to maintain close approximation of said first and second shearing planes for enhanced shearing action between said blades; said second support providing limited pivotal movement of said second blade; one of a combination of a wedge and a valley connected to said second blade and the other connected to said second support, the combination of the wedge and the valley interacting to apply pivotal force to move said second blade toward said first blade when limited pivotal movement is generated by said foreign matter interposed between said first and second blades during propeller rotation, wherein the improvement comprises:

a) said second support having an elongate, axially disposed cylindrical passage that holds a cylindrical member affixed to the second blade adapted for limited axial movement of the blade as the cylindrical member reciprocated within the passage, the passage provided with a lubricant seal at a forward end thereof and a lubricant seal at an aft end thereof for retention of lubricant within said passage;

b) said adjustable clamping means for limiting movement of said second blade including said elastic bias members applying tension between the cylindrical member and the passage to limit motion therebetween, the elastic bias members being enclosed within rigid elements including a piston sliding within an enclosing sleeve to prevent deformation of the elastic bias members over time;

c) said attaching means for fixedly attaching said second support to a non-rotating member of said hull comprising a rigid metal member having a first surface adapted for receiving thereon at least one alignment screw member threadedly engaged by said second support, the first surface provided with at least two threaded apertures for receiving threaded fasteners from said second support for removably affixing the metal member to said second support after said at least one alignment screw member has been adjusted to maintain said second shearing plane parallel to said first shearing plane; and d) a fixed rod extending upwardly from said first surface and an aperture in said second support arranged to loosely receive said rod therein while manipulating said alignment screw members.

* * * * *